United States Patent [19]

Hellwig

[11] 4,086,796

[45] May 2, 1978

[54] KEY CASE HEAD

[75] Inventor: Oskar Alexander Hellwig, Springfield, Mass.

[73] Assignee: Beatrice Foods Co., Chicago, Ill.

[21] Appl. No.: 803,300

[22] Filed: Jun. 3, 1977

[51] Int. Cl.[2] ..... A47G 29/10

[52] U.S. Cl. ..... 70/456 B

[58] Field of Search ..... 70/456–459; 24/3 K; 150/40

[56] References Cited

U.S. PATENT DOCUMENTS

| | | | |
|---|---|---|---|
| 2,630,700 | 3/1953 | Boden | 70/456 B |
| 2,709,358 | 5/1955 | Duell | 70/456 B |
| 3,176,490 | 4/1965 | Rinaldi | 70/456 B |

FOREIGN PATENT DOCUMENTS

| | | | |
|---|---|---|---|
| 509,929 | 1955 | Italy | 70/456 B |

*Primary Examiner*—Robert L. Wolfe

*Attorney, Agent, or Firm*—Chapin, Neal and Dempsey

[57] ABSTRACT

Key Case Head comprising a first generally cylindrically-shaped outer member having slot means in communication with offset openings, the offset openings being removed from either end of said slot means, the slot means being adapted to retain a key hook and the offset openings being adapted to permit a key hook to pass therethrough, and a second member disposed within the first member, the second member having slot means in alignment with the first member slot means and having recesses in communication therewith but offset therefrom, the second member being rotatably movable to selectively align the second member recesses with the first member openings to permit withdrawal or entrance of a key hook.

6 Claims, 6 Drawing Figures

KEY CASE HEAD

BACKGROUND OF THE INVENTION

1. Field of the Invention

This invention relates to key case heads and is directed more particularly to a key case having offset escape openings for the attached key hooks.

2. Description of the Prior Art

A variety of embodiments of key case heads are well known in the art and generally comprise inner and outer members, one stationary and one movable, to permit alignment of escape openings for the removal or entrance of key hooks.

The escape openings for the key hooks are larger in diameter than the width of the slot and permit the ball on the anchor end of the key hook to pass therethrough. It is generally the case, that the escape opening is provided at one end of the outer member slot and, by moving the first or second member, is aligned with a similar enlarged recess of the inner member so as to permit the key hook to be withdrawn from the inner and outer members. A problem with this arrangement has been that once a selected pair of openings and recesses are in alignment for the removal of a single key hook, so also are the remainder of the openings and recesses in alignment for removal of key hooks. It often happens that once all the escape openings and recesses are in alignment the key hooks tumble to one end of their respective slots and drop through the recesses and openings and thereby, undesirably, are detached from the key case.

SUMMARY OF THE INVENTION

It is an object of the present invention to provide a key case head in which the outer member openings and the inner member recesses are in communication with their respective slot means but are offset therefrom, to lessen the chances of key hooks dropping from their anchor means.

A further object is to provide such a key case head in which the outer member openings are removed from either end of the corresponding slot means to further lessen the chances of key hooks dropping from their anchor means.

A still further object is to provide such a key case head in which a channel interconnects each outer member slot and its respective offset opening, the channel member being of the same width as the slot, to still further reduce the chances of a key escaping by happenstance.

A still further object is to provide such a key case head which is easy to operate, simple in construction, and inexpensive to manufacture.

With the above and other objects in view, as will hereinafter appear, a feature of the present invention is the provision of a key case head comprising a first generally cylindrically-shaped outer member having slot means extending circumferentially thereof, each slot of said slot means having an opening in communication therewith but offset therefrom, each of said slots being adapted to movably retain a key hook therein and each of said offset openings being adapted to permit a key hook to pass therethrough, and a second member disposed within said first member, said second member having second slot means in alignment with said first member slot means, each slot of said second slot means having a recess in communication therewith but offset therefrom, said second member being rotatably movable to selectively align said second member recess with said first member opening to permit withdrawal or entrance of said key hook.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
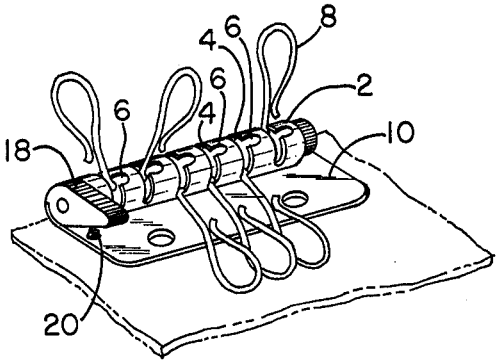
FIG. 1 is a perspective view of one form of key case head illustrative of an embodiment of the invention.
Figure 2:
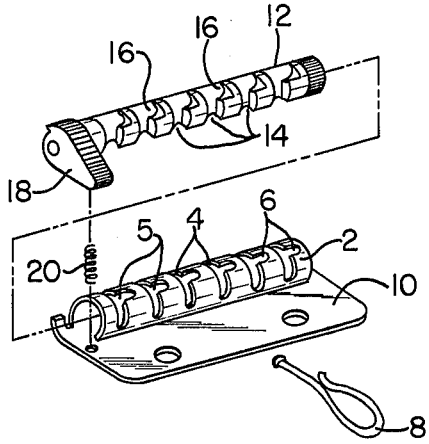
FIG. 2 is a perspective exploded view of the key case head of FIG. 1.
Figure 3:
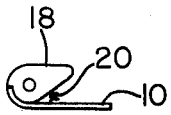
FIG. 3 is an end view thereof.
Figure 4:
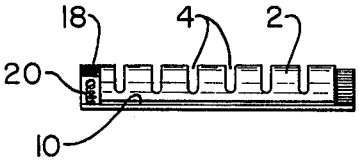
FIG. 4 is a front elevational view thereof.
Figure 5:
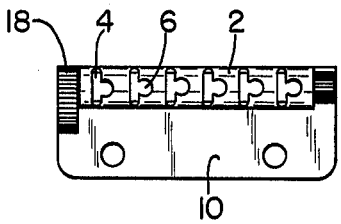
FIG. 5 is a top plan view thereof.
Figure 6:
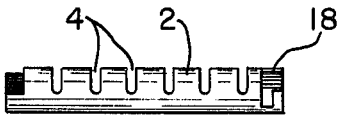
FIG. 6 is a back elevational view thereof.

Referring to the drawings, it will be seen that the illustrative device includes a first generally cylindrically-shaped outer member 2 having a series of slots 4 extending circumferentially thereof. Each slot 4 has a channel 5 in communication with an opening 6 offset from the slot. Each of the slots 4 is adapted to movably retain a key hook 8 (FIGS. 1 & 2) and each of the offset openings 6 is adapted to permit entry and removal of the key hook 8 therethrough. The channels 5 are preferably of the same width as the slots 4. The outer member 2 may be affixed to or may be an integral part of a flange portion 10 suitable for attachment to a key case of leather or other suitable material. The outer member 2 is preferably of metal or rigid plastic.

An inner member 12 (FIG. 2) is disposed within the outer member 2 and has a series of slots 14, each in communication with a recess 16 which is offset therefrom. The inner member slots 14 are in alignment with the outer member slots 4. The inner member recesses 16 are adapted to be aligned with the outer member openings 6. The inner member 12 is rotatable within the outer member 6 to selectively align the recesses 16 with the openings 6, thereby to permit entry or removal of a key hook 8. The inner member 12 is preferably of metal or a suitable rigid plastic.

The inner member 12 is provided at one end with an actuator 18 which is biased by a coil spring 20 to a position in which the recesses 16 are out of alignment with the openings 6. Accordingly, to release a key hook 8 from the key case head, it is necessary for an operator to manipulate the actuator 18 against the pressure of the spring 20 to rotate the inner member 12 to a position in which the recesses 16 are in alignment with the openings 6.

The openings 6 are removed from either end of their respective slots 4. Thus, when the key hooks tumble toward one end or the other of the slots 4, they are not in a position to escape from the device. Preferably, the axes of the openings 6 are disposed at angles substantially normal to the plane of the flange portion 10.

In operation, an operator so aligns the recesses 16 and the openings 6 that he may manually urge a key hook 8 longitudinally of the member 2, through the channel 5, out of the slots 14 and 4 and into their corresponding recesses and openings 16 and 6 to remove the key hook. For the key hook to be removed, it must be disposed in an attitude extending substantially radially outwardly from the member 2. The remaining key hooks in the assembly remain in the assembly until the operator urges the key hooks out of their respective slots and into their respective aligned recesses and openings. Upon release of the actuator 18, the spring 20 causes the inner member 12 to snap to a position in which the openings 6 and the recesses 16 are in non-aligned relationship.

It is unlikely that a key hook would be inadvertently released from the device of the present invention because (1) the recesses 16 and openings 6 must be aligned, against spring pressure, by an operator before a key hook may be withdrawn, (2) the width sizes of the slots 4 and the channels 5 are substantially equal, preventing a combination of open spaces sufficient to permit undesirable escape of the key hook and (3) even after the openings 6 and the recesses 16 are aligned, the key hook must be held in a position extending radially outwardly from the cylinder 2 in order to be clear of interference and be withdrawn, and (4) the openings 6 are removed from either end of their respective slots, and preferably at an angle normal to the flange 10, so that the key hooks would not be inclined to "dwell" at the location of the openings.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. Key Case Head comprising a first generally cylindrically-shaped outer member having slot means extending circumferentially thereof, each slot of said slot means having an opening in communication therewith but offset therefrom, each of said slots being adapted to movably retain a key hook and each of said offset openings being adapted to permit a key hook to pass therethrough, and a second member disposed within said first member, said second member having second slot means in alignment with said first member slot means, each slot of said second slot means having a recess in communication therewith but offset therefrom, said second member being rotatably movable to selectively align said second member recess with said first member opening to permit withdrawal or entrance of said key hook.

2. The invention according to claim 1 in which said second member is provided with an actuator for manual movement of said second member relative to said first member.

3. The invention according to claim 2 in which said actuator is biased to a position in which said second member recesses are out of alignment with said first member openings.

4. The invention according to claim 1 in which each of said openings is removed from either end of its respective slot.

5. The invention according to claim 4 in which the axes of said openings are disposed at angles substantially normal to the plane of a flange portion to which the first member is fixed.

6. The invention according to claim 1 in which each slot of said first slot means is in communication with said opening by way of a channel, said channel having a width substantially equal to the width of said slot of said first slot means.

* * * * *